US005733205A

United States Patent [19]

Higuchi et al.

[11] Patent Number: 5,733,205

[45] Date of Patent: Mar. 31, 1998

[54] MULTI-PIECE SOLID GOLF BALL

[75] Inventors: Hiroshi Higuchi; Hisashi Yamagishi; Junji Hayashi, all of Chichibu, Japan

[73] Assignee: Bridgestone Sports Co., Ltd., Tokyo, Japan

[21] Appl. No.: 661,776

[22] Filed: Jun. 13, 1996

[30] Foreign Application Priority Data

Jun. 14, 1995 [JP] Japan ..... 7-171522

[51] Int. Cl.[6] ..... A63B 37/06; A63B 37/12

[52] U.S. Cl. ..... 473/376; 473/373; 473/378

[58] Field of Search ..... 473/372, 373, 473/374, 376, 377, 378; 273/DIG. 22

[56] References Cited

U.S. PATENT DOCUMENTS 5,273,286 12/1993 Sun ..... 473/373

5,628,699 5/1997 Maruko et al. ..... 473/351 X

*Primary Examiner*—George J. Marlo

*Attorney, Agent, or Firm*—Sughrue, Mion, Zinn, Macpeak & Seas, PLLC

[57] ABSTRACT

A multi-piece solid golf ball comprising a core including an inner sphere and a surrounding layer and a cover enclosing the core and consisting of inner and outer cover layers is provided. The inner sphere has a distortion of 1.0–4.0 mm under a load of 100 kg, the surrounding layer is softer than the inner sphere, and the core has a distortion of 2.5–5.3 mm under a load of 100 kg. The outer cover layer has a hardness of at least 58 degrees on Shore D which is highest among the ball layers. The ratio A/B is between 0.3/1 and 1.4/1 wherein the inner sphere has a hardness A and the ball has a hardness B, both expressed by a distortion under a load of 100 kg. The ball maintains satisfactory flying performance and durability characteristic of solid golf balls and offers a pleasant soft feel, a click response and improved control.

10 Claims, 1 Drawing Sheet

MULTI-PIECE SOLID GOLF BALL

BACKGROUND OF THE INVENTION

1. Field of the Invention

This invention relates to a multi-piece solid golf ball having a structure of at least four layers and more particularly, to a multi-piece solid golf ball which offers a pleasant soft feel and a click response.

2. Prior Art

Golf balls of various structures are currently on the market. Among others, two-piece solid golf balls and thread-wound golf balls are commonly used in competitions. The two-piece solid golf ball has a rubber based core and an enclosing cover typically of ionomer resin while the thread-wound golf ball is produced by winding thread rubber around a solid or liquid center and enclosing the center with a cover.

The two-piece solid golf balls are used by many ordinary golfers because of superior flying performance and durability although they have the drawbacks including a very hard feel upon hitting and less controllability because of quick separation from the club face upon impact. Because of these drawbacks of two-piece solid golf balls, many professional golfers and skilled amateur golfers favor wound golf balls. As compared with the two-piece solid golf balls, wound golf balls are superior in feel and control, but inferior in carry and durability. Under the present situation that two-piece solid golf balls and wound golf balls have contradictory characteristics as mentioned above, players make a choice of golf balls depending on their own skill and taste.

various proposals have been made on solid golf balls in order to develop a new type of three-piece solid golf ball capable of affording a feel close to that of wound golf balls. For the purpose of accomplishing a long carry and a hitting feel and controllability close to wound golf balls, Japanese Patent Publication (JP-B) No. 55077/1992 and Japanese Patent Application Kokai (JP-A) No. 80377/1989, for example, discloses a core in which a soft, relatively small inner layer (outer diameter: 24 to 29 mm, hardness: 15° to 30° on Shore D) is enclosed with a hard outer layer (outer diameter: 36 to 41 mm, hardness: 55° to 65° on Shore D). Also for the purpose of improving the hitting feel at no sacrifice of superior flying performance and durability characteristic of solid golf balls, JP-A 24084/1995 discloses the provision of a soft intermediate layer between the center core and the cover or outermost layer of the ball. The three-layer structure is proposed in JP-A 24084/1995 for imparting a soft feel which is never achievable with two-piece balls. This is advantageous in pursuit of softness, but fails to provide a golf ball with both a soft feel and a click response as accomplished by the present invention. Due to its softness, the golf ball of JP-A 24084/1995 offers a pleasant soft feel upon hitting, but its response is a little unreliable and passive.

SUMMARY OF THE INVENTION

Therefore, an object of the present invention is to provide a multi-piece solid golf ball which maintains satisfactory flying performance and durability characteristic of solid golf balls and offers a pleasant soft feel and a click response.

To attain this and other objects, the inventors have focused on a multi-piece solid golf ball comprising at least four layers and examined the hardness of the inner sphere relative to the hardness of the core, the hardness of the inner sphere relative to the hardness of the ball, and the hardness of the inner and outer cover layers. They have found that the objects are achieved when the inner sphere has an adequate hardness, the layer surrounding the inner sphere is softer than the inner sphere, the outer cover layer is made hard, and a soft inner cover layer is inside the outer cover layer. While the ball maintains satisfactory flying performance and a soft feel, the ball offers a sure "click" response to the hands and is improved in controllability.

More particularly, the inner sphere has an adequate hardness expressed by a distortion of 1.0 to 4.0 mm under a load of 100 kg, the surrounding layer is softer than the inner sphere, and the core has a distortion of 2.5 to 5.3 mm under a load of 100 kg. The outer cover layer has a hardness of at least 58 degrees on Shore D which is highest among the ball layers while a soft inner cover layer is inside the outer cover layer. Then a soft hitting feel with a click response is obtainable without detracting from a carry or flying distance. Additionally, the ratio A/B is between 0.3/1 and 1.4/1 wherein the inner sphere has a hardness A and the ball has a hardness B, both expressed by a distortion under a load of 100 kg. Due to the synergistic effect of these parameters, the multi-piece solid golf ball maintains satisfactory flying performance and durability characteristic of solid golf balls and offers a pleasant soft feel upon hitting and a click response that satisfies professional and skilled golfers. The ball yields a sufficient amount of deformation to afford control when hit by a short iron or sand wedge on short games like approach shots.

Accordingly, the invention provides a multi-piece solid golf ball comprising a core including an inner sphere and at least one layer surrounding the inner sphere and a cover enclosing the core and consisting of inner and outer cover layers. The inner sphere has a hardness A expressed by a distortion of 1.0 to 4.0 mm under a load of 100 kg. The surrounding layer has a lower hardness than the inner sphere. The core has a hardness expressed by a distortion of 2.5 to 5.3 mm under a load of 100 kg. The outer cover layer has a hardness of at least 58 degrees on Shore D which is highest among the ball layers. The ratio A/B is between 0.3/1 and 1.4/1 wherein the inner sphere has a hardness A and the ball has a hardness B, both expressed by a distortion under a load of 100 kg.

DETAILED DESCRIPTION OF THE INVENTION

Figure 1:
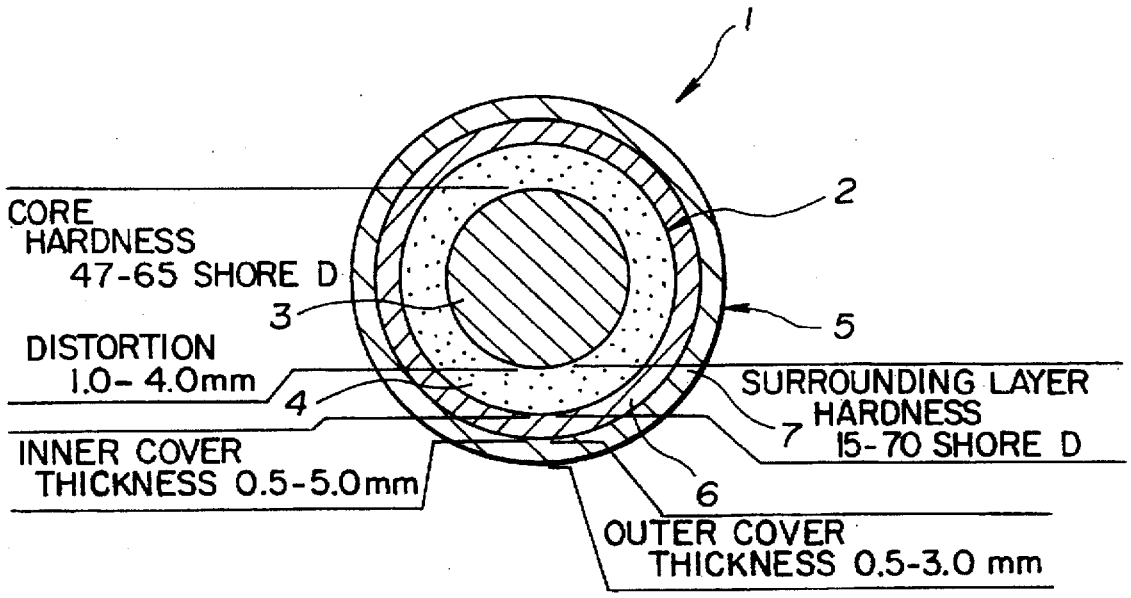
FIG. 1 is a schematic cross section of one exemplary multi-piece solid golf ball according to the invention.

Referring to FIG. 1, there is illustrated one exemplary structure of the golf ball according to the invention. The ball generally designated at 1 includes a solid core 2 consisting of an inner sphere 3 and a layer 4 surrounding the inner sphere and a cover 5 around the core consisting of inner and outer cover layers 6 and 7. The surrounding layer 4 may be a single layer or have a plurality of layers. In the former case, the golf ball is of the four layer structure. According to the feature of the invention, the outer cover layer 7 is hardest among the ball layers and the surrounding layer 4 around the inner sphere 3 is softer than the inner sphere.

The outer cover layer 7 is formed to a Shore D hardness of at least 58 degrees, preferably 58 to 80 degrees, more preferably 58 to 70 degrees. With a hardness of less than 58 degrees, the ball is reduced in restitution or repulsion, failing to provide satisfactory flying performance. The inner cover layer 6 preferably has a Shore D hardness of up to 57 degrees, more preferably 35 to 56 degrees. If the inner cover layer hardness exceeds 57 degrees, the ball would offer a rather hard feel. If the inner cover layer hardness is less than 35 degrees, the ball would be reduced in restitution.

The inner cover layer 6 is formed softer than the outer cover layer 7. The objects of the invention are not achieved if the inner cover layer 6 is harder than the outer cover layer 7. It is recommended for the objects of the invention that the inner cover layer 6 is softer than the outer cover layer 7 by a hardness difference of at least 5 degrees, more preferably 6 to 40 degrees, most preferably 7 to 35 degrees on Shore D scale.

Preferably the outer cover layer 7 has a gage (or radial thickness) of 0.5 to 3.0 mm, especially 1.0 to 2.5 mm, the inner cover layer 6 has a gage of 0.5 to 5.0 mm, especially 1.0 to 4.0 mm, and the entire cover 5 has a gage of 1.0 to 8.0 mm, especially 2.0 to 6.5 mm. If the outer cover layer 7 is too thin, the ball would be less durable. If the outer cover layer 7 is too thick, restitution would be lost. If the inner cover layer 6 is too thin, the feel is exacerbated. If the inner cover layer 6 is too thick, restitution would be lost. If the entire cover 5 is too thin, the ball would be less durable and poor in feel. If the entire cover 5 is too thick, restitution would be lost, failing to provide satisfactory flying performance.

The inner and outer cover layers 6 and 7 may be formed to the above-defined hardness using thermoplastic resins such as ionomer resins and non-ionomer resins alone or in admixture.

In the core 2, the inner sphere 3 has a hardness expressed by a distortion of 1.0 to 4.0 mm, preferably 1.8 to 3.2 mm under a load of 100 kg. If the inner sphere 3 has a too low hardness (distortion>4.0 mm), restitution would be lost to provide a shorter carry and no click response is obtainable despite a good hitting feel. If the inner sphere 3 has a too high hardness (distortion<1.0 mm), the feel would be exacerbated. It is noted that the inner sphere 3 preferably has a hardness of 47 to 65 degrees, especially 48 to 60 degrees on Shore D.

Like the core of prior art two-piece solid golf balls, the inner sphere 3 may be formed of a rubber material based on polybutadiene which is vulcanized with an organic peroxide with the aid of a crosslinking agent such as zinc (meth) acrylate.

The surrounding layer 4 around the inner sphere 3 preferably has a hardness of 15 to 70 degrees, more preferably 20 to 55 degrees, especially 33 to 53 degrees on Shore D. It is essential for the invention to exert its advantages that the hardness of the surrounding layer 4 be lower than the hardness of the inner sphere 3. The core 2 having the inner sphere 3 and the surrounding layer 4 combined should have a hardness expressed by a distortion of 2.5 to 5.3 mm, preferably 2.6 to 4.8 mm under a load of 100 kg.

The inner sphere 3 should preferably have a diameter of up to 35 mm, especially 15 to 32 mm. If the diameter of the inner sphere 3 is too small, restitution would be insufficient. If the diameter of the inner sphere 3 is too large, the hitting feel would be exacerbated. The core 2 preferably has a diameter of 30 to 39 mm, especially 32 to 37 mm.

The surrounding layer 4 may be formed mainly of thermoplastic resins such as ionomer resins or rubber base materials like the inner sphere 3.

Provided that the inner sphere 3 and the golf ball have a hardness A and B, respectively, both expressed by a distortion under a load of 100 kg, the ratio A/B should lie between 0.3/1 and 1.4/1, especially between 0.4/1 and 1.3/1. If the ratio A/B is less than 0.3, the ball has a poor hitting feel. If the ratio A/B is more than 1.4, both satisfactory flying performance and a click response are not obtainable at the same time. It is noted that the golf ball preferably undergoes a compression or distortion of 2.3 to 4.5 mm, especially 2.5 to 4.0 mm under a load of 100 kg.

In the practice of the invention, the material and preparation of the core are not critical. Any of well-known materials and methods may be used insofar as the above-mentioned golf ball properties are achievable.

More particularly, the inner sphere of the core of the golf ball according to the invention may be prepared by a conventional technique while properly adjusting vulcanizing conditions and formulation. Usually the inner sphere is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polybutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 0.5 to 1.0 part by weight of the crosslinking agent is blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. About 5 to 55 parts by weight of the co-crosslinking agent is blended with 100 parts by weight of the base rubber. Examples of the inert filler include zinc oxide, barium sulfate, silica, calcium carbonate, and zinc carbonate, with zinc oxide and barium sulfate being often used. The amount of the filler blended is preferably about 10 to about 100 parts by weight per 100 parts by weight of the base rubber. In the practice of the invention, the amount of the filler (typically zinc oxide and barium sulfate) is properly selected so as to provide the desired hardness to the inner sphere.

An inner sphere-forming composition is prepared by kneading the above-mentioned components in a conventional mixer such as a Banbury mixer and roll mill, and it is compression or injection molded in an inner sphere mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining an inner sphere.

Where the solid core consists of an inner sphere and a single surrounding layer, the surrounding layer may be formed of a composition similar to the composition used for the inner sphere or another resin composition based on an ionomer resin or the like. The surrounding layer can be formed on the inner sphere by compression molding or injection molding. Where more than one surrounding layer is included, they may be similarly formed.

The materials of which the inner and outer cover layers are formed are not critical. These layers may be formed of any of well-known cover materials, especially ionomer resin based materials. Desired properties are conveniently obtained using a mixture of two or more ionomer resins. If desired, well-known additives such as pigments, dispersants, anti-oxidants, UV absorbers, UV stabilizers, and plasticizers may be added to the ionomer resin(s). The cover composition may be molded over the solid core by any desired method, for example, by surrounding the core by a pair of preformed hemispherical cups followed by heat compression molding or by injection molding the cover composition over the core.

Like conventional golf balls, the golf ball of the invention is formed with a multiplicity of dimples in the cover surface. The geometrical arrangement of dimples may be octahedral, eicosahedral or the like while the dimple pattern may be selected from square, hexagon, pentagon, and triangle patterns.

The golf ball of the invention is prepared in accordance with the Rules of Golf, that is, to a diameter of at least 42.67 mm for the large size (or a diameter of at least 41.15 mm for the small size) and a weight of not greater than 45.93 grams.

There has been described a multi-piece solid golf ball which offers a pleasant soft feel, a click response and improved controllability without detracting from satisfactory flying performance and durability characteristic of solid golf balls.

EXAMPLE

Examples of the present invention are given below by way of illustration and not by way of limitation.

Examples 1–7 & Comparative Examples 1–4

Golf balls were prepared by the following procedure. An inner sphere was prepared by milling an inner sphere-forming rubber composition of the formulation shown in Table 1 in a roll mill and compression molding it at 155° C. for 15 minutes. Using the formulation shown in Table 1, a surrounding layer was molded over the inner sphere to form a core.

Inner and outer cover layer-forming compositions of the formulation shown in Table 1 were successively injection molded over the core, completing a golf ball.

It is noted that all the amounts of components reported in Table 1 are parts by weight and they are independently expressed in each of the inner sphere, surrounding layer, and cover layers.

TABLE 1

| | E1 | E2 | E3 | E4 | E5 | E6 | E7 | CE 1 | CE 2 | CE 3 | CE 4 |
|---|---|---|---|---|---|---|---|---|---|---|---|
| Core | | | | | | | | | | | |
| Inner sphere composition | | | | | | | | | | | |
| 1,4-polybutadiene (cis structure) | 100 | 100 | 100 | 100 | 100 | 100 | 100 | 100 | 100 | 100 | 100 |
| Zinc acrylate | 37 | 45 | 31.5 | 34 | 35 | 30 | 35 | 16 | 31 | 18.5 | 32.5 |
| Dicumyl peroxide | 0.9 | 0.9 | 0.9 | 0.9 | 0.9 | 0.9 | 0.9 | 0.9 | 0.9 | 0.9 | 0.9 |
| Anti-oxidant | 0.2 | 0.2 | 0.2 | 0.2 | 0.2 | 0.2 | 0.2 | 0.2 | 0.2 | 0.2 | 0.2 |
| Zinc oxide | 5 | 5 | 5 | 5 | 5 | 5 | 5 | 5 | 5 | 5 | 5 |
| Barium sulfate | 18 | 18 | 20 | 16 | 3 | 20.5 | 25 | 142.5 | 20.5 | 24 | 18 |
| Surrounding layer composition | | | | | | | | | | | |
| Thermoplastic resin | | | | | | | | | | | |
| Hytrel 8122 | — | — | — | — | — | — | 100 | — | — | — | — |
| Himilan 1605 | — | — | — | — | — | — | — | 50 | — | — | — |
| Himilan 1706 | — | — | — | — | — | — | — | 50 | — | — | — |
| Rubber material | | | | | | | | | | | |
| 1,4-polybutadiene (cis structure) | 100 | 100 | 100 | 100 | 100 | 100 | — | — | — | — | — |
| Zinc acrylate | 23.5 | 20.5 | 19 | 18 | 23.5 | 23.5 | 17 | — | — | — | — |
| Dicumyl peroxide | 0.9 | 0.9 | 0.9 | 0.9 | 0.9 | 0.9 | — | — | — | — | — |
| Anti-oxidant | 0.2 | 0.2 | 0.2 | 0.2 | 0.2 | 0.2 | — | — | — | — | — |
| Zinc oxide | 5 | 5 | 5 | 5 | 5 | 5 | — | — | — | — | — |
| Barium sulfate | 24 | 28 | 25 | 23 | 8 | 23.5 | — | — | — | — | — |
| Cover | | | | | | | | | | | |
| Inner layer composition | | | | | | | | | | | |
| Hytrel 4047 | 100 | 100 | 100 | — | 100 | 100 | — | — | 100 | — | — |
| Hytrel 4767 | — | — | — | — | — | — | 100 | — | — | — | — |
| Hytrel 5557 | — | — | — | 100 | — | — | — | — | — | — | — |
| Outer layer composition | | | | | | | | | | | |
| Himilan AM7317 | — | — | 50 | — | — | 50 | 50 | 50 | — | 50 | — |
| Himilan AM7318 | — | — | 50 | — | — | 50 | 50 | 50 | — | 50 | — |
| Himilan 1605 | 50 | 50 | — | — | 50 | — | — | — | 50 | — | — |
| Himilan 1706 | 50 | 50 | — | — | 50 | — | — | — | 50 | — | 50 |
| Himilan 1601 | — | — | — | 50 | — | — | — | — | — | — | — |
| Himilan 1557 | — | — | — | 50 | — | — | — | — | — | — | — |
| Surlyn 8120 | — | — | — | — | — | — | — | — | — | — | 50 |

The golf balls were examined for spin, carry, total distance, angle, and feel by hitting the balls with a driver (#W1) at a head speed (HS) of 50 m/sec. and No. 9 iron at a head speed of 42 m/sec. The balls were also examined for feel by hitting with a sand wedge at a head speed of 19 m/sec. The results are shown in Table 2.

Three professional golfers actually hit the golf balls to examine their hitting feel. The ball was rated "◎" for a soft feel and a click response, "○" for a soft feel without a click response, "Δ" for a little hard feel, and "X" for a hard feel.

TABLE 2

| | E1 | E2 | E3 | E4 | E5 | E6 | E7 | CE 1 | CE 2 | CE 3 | CE 4 |
|---|---|---|---|---|---|---|---|---|---|---|---|
| Inner sphere | | | | | | | | | | | |
| Diameter (mm) | 20.0 | 16.0 | 28.0 | 22.0 | 28.0 | 28.0 | 30.0 | 24.4 | 35.3 | 38.5 | 38.5 |
| (A)Hardness* @100 kg | 2.5 | 2.0 | 3.2 | 2.8 | 2.7 | 3.5 | 2.7 | 6.9 | 3.3 | 6.0 | 3.0 |
| Surrounding layer | | | | | | | | | | | |
| Diameter (mm) | 35.3 | 32.1 | 35.9 | 36.3 | 36.6 | 35.9 | 34.3 | 38.3 | — | — | — |
| Shore D | 43 | 38 | 36 | 35 | 43 | 43 | 33 | 65 | — | — | — |
| Core | | | | | | | | | | | |
| Hardness* @100 kg | 3.9 | 3.8 | 3.8 | 4.4 | 3.2 | 3.6 | 2.9 | 4.4 | — | — | — |
| Inner cover layer | | | | | | | | | | | |
| Gage (mm) | 1.7 | 3.3 | 1.4 | 1.7 | 1.7 | 1.4 | 2.2 | — | 1.7 | — | — |
| Shore D | 40 | 40 | 40 | 55 | 40 | 40 | 47 | — | 40 | — | — |
| Outer cover layer | | | | | | | | | | | |
| Gage (mm) | 2.0 | 2.0 | 2.0 | 1.5 | 1.6 | 2.0 | 2.0 | 2.2 | 2.0 | 2.1 | 2.1 |
| Shore D | 65 | 65 | 68 | 62 | 65 | 68 | 68 | 67 | 65 | 68 | 55 |
| Ball | | | | | | | | | | | |
| Diameter (mm) | 42.7 | 42.7 | 42.7 | 42.7 | 43.3 | 42.7 | 42.7 | 42.7 | 42.7 | 42.7 | 42.7 |
| (B)Hardness* @100 kg | 3.1 | 3.2 | 3.2 | 3.0 | 2.9 | 2.9 | 2.6 | 3.3 | 2.5 | 4.0 | 2.7 |
| A/B | 0.81 | 0.74 | 1.00 | 0.93 | 0.90 | 1.21 | 1.04 | 2.09 | 1.32 | 1.50 | 1.11 |
| #W1/HS50 | | | | | | | | | | | |
| Spin (rpm) | 2720 | 2740 | 2650 | 2670 | 2710 | 2630 | 2720 | 2530 | 2620 | 2040 | 2830 |
| Carry (m) | 234.7 | 235.1 | 234.8 | 234.6 | 234.5 | 234.7 | 234.3 | 230.3 | 233.2 | 229.8 | 233.8 |
| Total (m) | 246.8 | 246.7 | 247.3 | 247.1 | 246.7 | 247.5 | 246.5 | 243.9 | 245.8 | 244.1 | 244.9 |
| Angle (°) | 12.3 | 12.3 | 12.5 | 12.5 | 12.4 | 12.5 | 12.3 | 12.2 | 12.5 | 12.0 | 12.8 |
| Feel | ◎ | ◎ | ◎ | ◎ | ◎ | ◎ | ◎ | ○ | ○ | ○ | Δ |
| #I9/HS42 | | | | | | | | | | | |
| Spin (rpm) | 10120 | 10180 | 10020 | 10170 | 10080 | 10010 | 10050 | 9930 | 10050 | 8860 | 10520 |
| Carry (m) | 128.3 | 128.5 | 128.2 | 128.4 | 128.3 | 128.4 | 128.2 | 127.6 | 127.8 | 126.2 | 127.5 |
| Total (m) | 128.6 | 128.7 | 128.8 | 128.6 | 128.6 | 128.8 | 128.6 | 128.3 | 128.4 | 127.3 | 127.6 |
| Feel | ◎ | ◎ | ◎ | ◎ | ◎ | ◎ | ◎ | Δ | ○ | ○ | x |
| #SW/HS19 | | | | | | | | | | | |
| Feel | ○ | ○ | ○ | ○ | ○ | ○ | ○ | x | Δ | Δ | Δ |

*a distortion (mm) under a load of 100 kg

As is evident from Table 2, the golf balls of the invention has superior flying performance, an improved spin rate, and a pleasant soft feel with a click response.

Although some preferred embodiments have been described, many modifications and variations may be made thereto in the light of the above teachings. It is therefore to be understood that within the scope of the appended claims, the invention may be practiced otherwise than as specifically described.

We claim:

1. A multi-piece solid golf ball comprising a core including an inner sphere and at least one layer surrounding the inner sphere and a cover enclosing the core and consisting of inner and outer cover layers, characterized in that said inner sphere has a hardness A expressed by a distortion of 1.0 to 4.0 mm under a load of 100 kg, said surrounding layer has a lower hardness than said inner sphere, said core has a hardness expressed by a distortion of 2.5 to 5.3 mm under a load of 100 kg, said outer cover layer has a hardness of at least 58 degrees on Shore D which is highest among the ball layers, and the ratio A/B is between 0.3/1 and 1.4/1 wherein said inner sphere has a hardness A and said ball having a hardness B, both expressed by a distortion under a load of 100 kg.

2. The golf ball of claim 1 wherein said inner sphere has a diameter of up to 35 mm, said core has a diameter of 30 to 39 mm, and said surrounding layer has a hardness of 15 to 70 degrees on Shore D.

3. The golf ball of claim 1 wherein said outer cover layer has a gage of 0.5 to 3.0 mm, and said inner cover layer has a gage of 0.5 to 5.0 mm and a hardness of up to 57 degrees on Shore D.

4. The golf ball of claim 1 wherein said outer cover has a hardness in the range of 58 to 80 on Shore D.

5. The golf ball of claim 1 wherein said inner cover has a hardness in the range of 35 to 56 on Shore D.

6. The golf ball of claim 1 wherein said inner sphere has a hardness A in the range of 1.8 to 3.2 mm under a load of 100 kg.

7. The golf ball of claim 1 wherein said inner sphere has a hardness of 47 to 65 on Shore D.

8. The golf ball of claim 2 wherein said surrounding layer has a hardness of 20 to 55 on Shore D.

9. The golf ball of claim 1 wherein said inner sphere and said surrounding layer combined have a hardness expressed by a distortion of 2.5 to 5.3 mm under a load of 100 kg.

10. The golf ball of claim 1 wherein said inner sphere has a diameter in the range of 15 to 32 mm.

* * * * *